US009926154B1

(12) United States Patent
Tsai et al.

(10) Patent No.: US 9,926,154 B1
(45) Date of Patent: Mar. 27, 2018

(54) PAPER FEEDING DEVICE

(71) Applicant: Foxlink Image Technology Co., Ltd., New Taipei (TW)

(72) Inventors: Yuan Hao Tsai, New Taipei (TW); Chien Jen Chen, New Taipei (TW); Shih Wei Tseng, New Taipei (TW); Yi Hong Chen, New Taipei (TW)

(73) Assignee: Foxlink Image Technology Co., Ltd., New Taipei (TW)

( * ) Notice: Subject to any disclaimer, the term of this patent is extended or adjusted under 35 U.S.C. 154(b) by 0 days.

(21) Appl. No.: 15/440,187

(22) Filed: Feb. 23, 2017

(51) Int. Cl.

| | |
|---|---|
| ***B65H 7/02*** | (2006.01) |
| ***B65H 3/06*** | (2006.01) |
| ***B65H 5/06*** | (2006.01) |
| ***B41L 21/02*** | (2006.01) |

(52) U.S. Cl.
CPC ..... *B65H 7/02* (2013.01); *B41L 21/02* (2013.01); *B65H 3/06* (2013.01); *B65H 5/06* (2013.01); *B65H 2553/30* (2013.01)

(58) Field of Classification Search
CPC ... B65H 7/02; B65H 7/18; B65H 7/20; B65H 2511/13
USPC ..... 271/10.02, 10.03, 263, 265.04
See application file for complete search history.

(56) References Cited

U.S. PATENT DOCUMENTS

2004/0150155 A1* 8/2004 Okitsu ..... B65H 7/125 271/262
2015/0048566 A1* 2/2015 Utagawa ..... B65H 7/125 271/10.02

* cited by examiner

*Primary Examiner* — David H Bollinger
(74) *Attorney, Agent, or Firm* — Lin & Associates Intellectual Property, Inc.

(57) ABSTRACT

A paper feeding device includes a pickup mechanism, a conveying mechanism disposed behind the pickup mechanism, a separation mechanism disposed behind the conveying mechanism, a feeding mechanism disposed behind the separation mechanism, a transmission mechanism driving the pickup mechanism, the conveying mechanism, the separation mechanism and the feeding mechanism, and an ultrasonic circuit unit disposed between the separation mechanism and the transmission mechanism. The ultrasonic circuit unit includes an ultrasonic detecting module, an amplifying circuit unit electrically connected with the ultrasonic detecting module, a paper density detecting unit electrically connected with the amplifying circuit unit, an analog-to-digital converter electrically connected with the paper density detecting unit, a processor electrically connected with the analog-to-digital converter, and a driving unit electrically connected with the processor and the transmission mechanism.

8 Claims, 2 Drawing Sheets

PAPER FEEDING DEVICE

BACKGROUND OF THE INVENTION

1. Field of the Invention

The present invention generally relates to a paper feeding device, and more particularly to a paper feeding device capable of effectively preventing paper being damaged.

2. The Related Art

Nowadays, a conventional paper feeding device is applied to an office equipment. The office equipment is capable of being a printer and so on. The paper feeding device for feeding paper, generally includes a pickup mechanism, a conveying mechanism, a separation mechanism, a feeding mechanism and a transmission mechanism. The conveying mechanism is mounted behind the pickup mechanism. The separation mechanism is mounted behind the conveying mechanism. The feeding mechanism is mounted behind the separation mechanism. The pickup mechanism, the conveying mechanism, the separation mechanism and the feeding mechanism are controlled by the transmission mechanism.

However, when the conventional paper feeding device works, the transmission mechanism rotates at a uniform velocity, if the paper is thinner, the paper will be easily damaged. As a result, image quality of the office equipment applying the conventional paper feeding device is easily affected.

Thus, whether the above-mentioned problem is solved by virtue of designing an innovative paper feeding device has become an important issue which is to be solved by skilled persons in the art, so the innovative paper feeding device capable of effectively preventing paper being damaged is needed to be provided so as to improve the above-mentioned problem.

SUMMARY OF THE INVENTION

An object of the present invention is to provide a paper feeding device. The paper feeding device includes a pickup mechanism for picking up paper and transmitting the paper backward, a conveying mechanism disposed behind the pickup mechanism for conveying the paper transmitted by the pickup mechanism backward, a separation mechanism disposed behind the conveying mechanism for separating the paper conveyed by the conveying mechanism and transmitting the separated paper backward, a feeding mechanism disposed behind the separation mechanism for feeding the paper transmitted by the separation mechanism backward, a transmission mechanism electrically connected with and driving the pickup mechanism, the conveying mechanism, the separation mechanism and the feeding mechanism, and an ultrasonic circuit unit disposed between the separation mechanism and the transmission mechanism. The ultrasonic circuit unit includes an ultrasonic detecting module for detecting paper signals, an amplifying circuit unit electrically connected with the ultrasonic detecting module for amplifying the paper signals into amplified paper signals, a paper density detecting unit electrically connected with the amplifying circuit unit for analyzing a density of each piece of paper to determine a thickness of the each piece of paper, an analog-to-digital converter for converting the amplified paper signals into digital signals being electrically connected with the paper density detecting unit, a processor electrically connected with the analog-to-digital converter, the digital signals being transmitted to the processor, and a driving unit electrically connected with the processor and the transmission mechanism. The processor controls the driving unit to modulate rotation speeds of the transmission mechanism for being appropriate to different thicknesses of the paper.

As described above, the ultrasonic circuit unit analyzes the density of the each piece of paper to determine the thickness of the each piece of paper to modulate the rotation speeds of the transmission mechanism for being appropriate to the different thicknesses of the paper, even the paper is thinner, the paper feeding device is capable of effectively preventing the paper being damaged. As a result, image quality of an office equipment applying the paper feeding device is improved.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
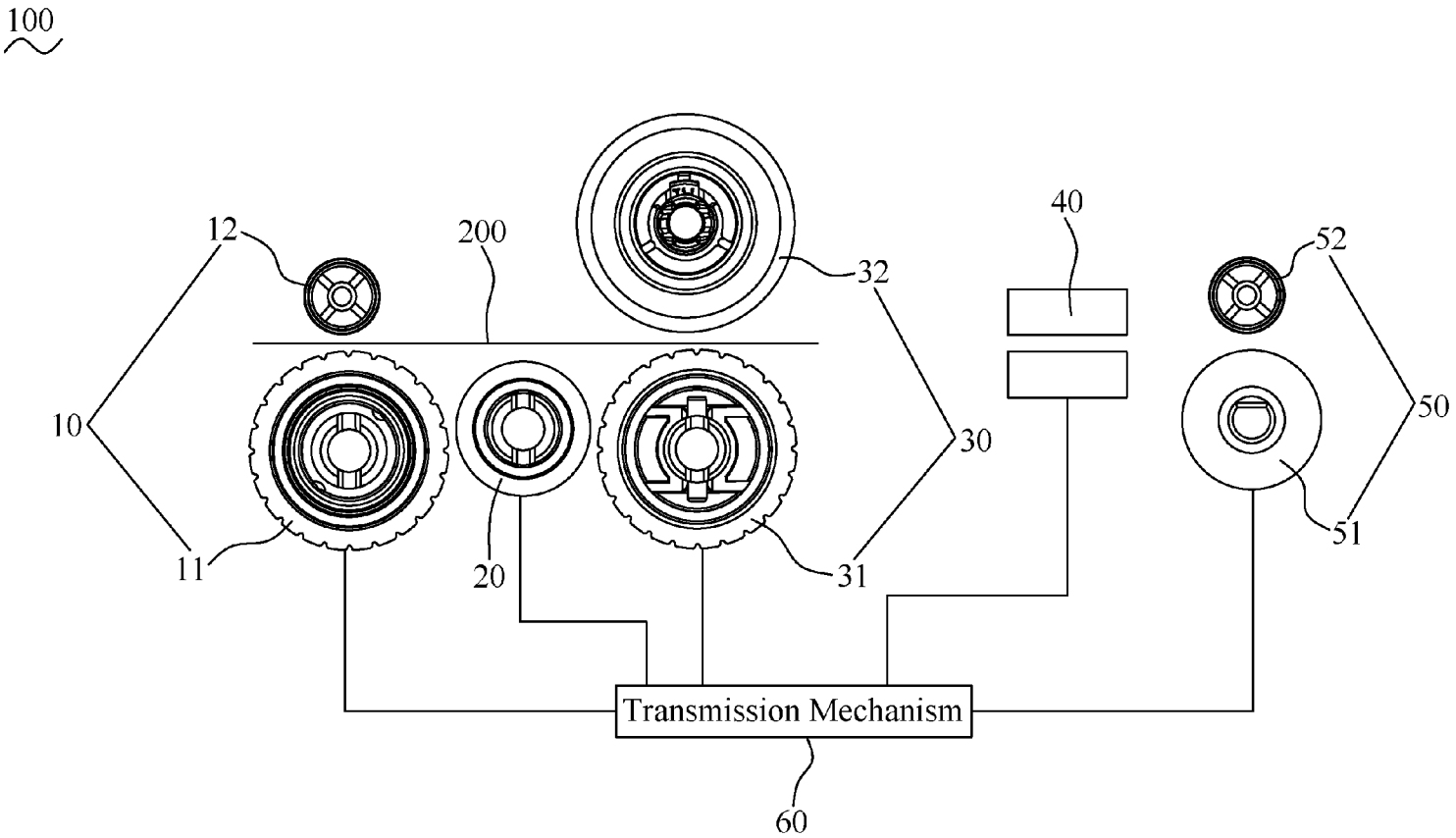
FIG. 1 is a schematic diagram of a paper feeding device in accordance with a preferred embodiment of the present invention.
Figure 2:
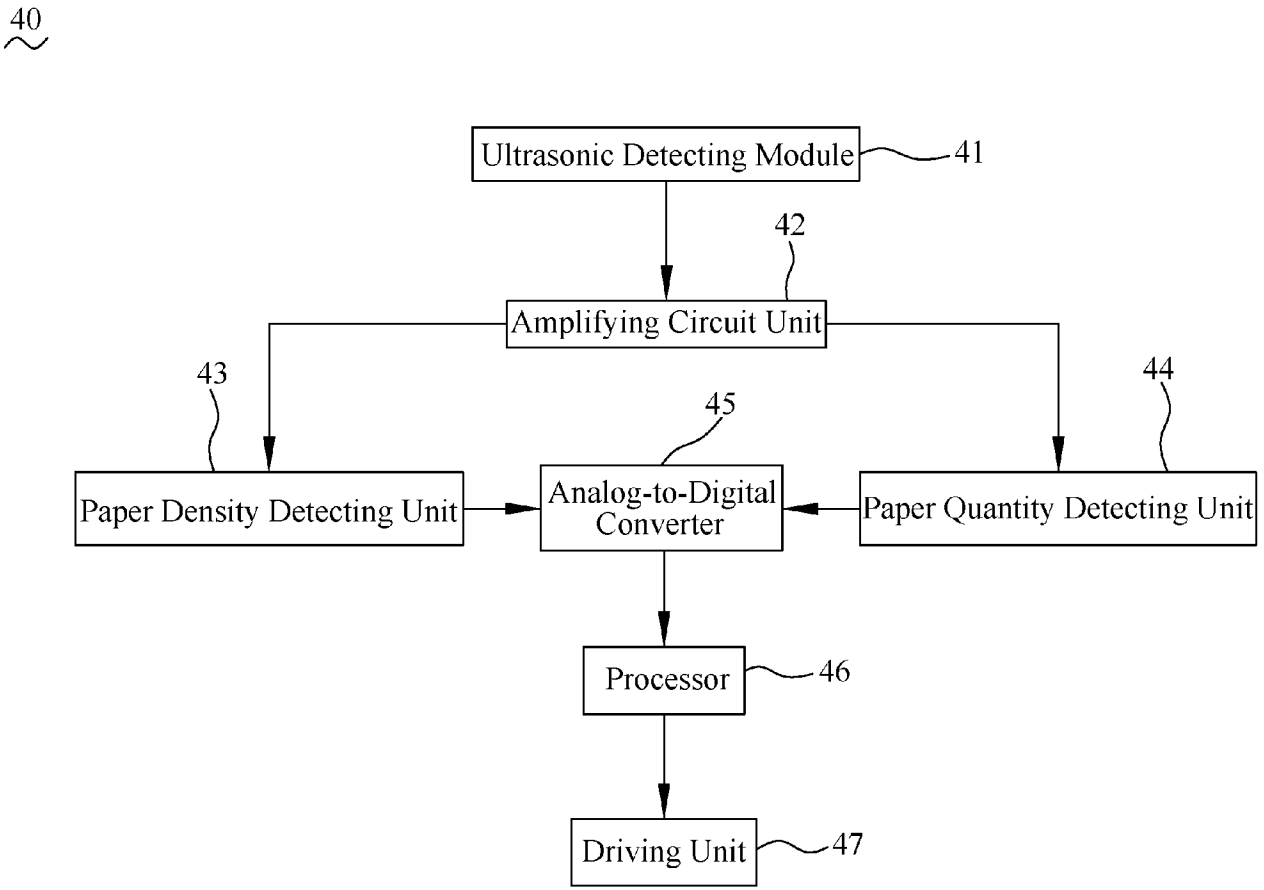
FIG. 2 is a block diagram of an ultrasonic circuit unit of the paper feeding device of FIG. 1.

With reference to FIG. 1 and FIG. 2, a paper feeding device 100 in accordance with a preferred embodiment of the present invention is shown. The paper feeding device 100 is applied to an office equipment (not shown). The office equipment is capable of being a printer and so on for feeding paper 200. The paper feeding device 100 includes a pickup mechanism 10, a conveying mechanism 20, a separation mechanism 30, an ultrasonic circuit unit 40, a feeding mechanism 50, and a transmission mechanism 60 electrically connected with and driving the pickup mechanism 10, the conveying mechanism 20, the separation mechanism 30 and the feeding mechanism 50. In this preferred embodiment, the transmission mechanism 60 is capable of being a motor.

Referring to FIG. 1, the pickup mechanism 10 is for picking up the paper 200 and transmitting the paper 200 backward to the conveying mechanism 20. The pickup mechanism 10 includes a pickup driving pulley 11 and a pickup following pulley 12. The pickup driving pulley 11 and the pickup following pulley 12 are mounted in the office equipment. The pickup following pulley 12 is disposed above the pickup driving pulley 11. The pickup driving pulley 11 is driven by the transmission mechanism 60.

The conveying mechanism 20 is mounted in the office equipment. The conveying mechanism 20 is disposed behind the pickup driving pulley 11 of the pickup mechanism 10 for conveying the paper 200 transmitted by the pickup mechanism 10 backward to the separation mechanism 30.

The separation mechanism 30 is disposed behind the conveying mechanism 20 for separating the paper 200 conveyed by the conveying mechanism 20 and transmitting the separated paper 200 backward to the ultrasonic circuit unit 40 piece by piece. The separation mechanism 30 includes a separation driving pulley 31 and a separation following pulley 32. The separation driving pulley 31 and the separation following pulley 32 are mounted in the office equipment. The separation following pulley 32 is disposed above the separation driving pulley 31. The separation driving pulley 31 is driven by the transmission mechanism 60.

Referring to FIG. 1 and FIG. 2, the ultrasonic circuit unit 40 is mounted in the office equipment, and the ultrasonic circuit unit 40 is disposed between the separation mechanism 30 and the transmission mechanism 60. The ultrasonic circuit unit 40 is disposed behind the separation mechanism 30. The ultrasonic circuit unit 40 includes an ultrasonic detecting module 41 for detecting paper signals, an amplifying circuit unit 42, a paper density detecting unit 43, a paper quantity detecting unit 44, an analog-to-digital converter 45, a processor 46 and a driving unit 47.

The amplifying circuit unit 42 is electrically connected with the ultrasonic detecting module 41 for amplifying the paper signals into amplified paper signals. The paper density detecting unit 43 is electrically connected with the amplifying circuit unit 42 to receive the amplified paper signals for analyzing a density of each piece of paper 200 to determine a thickness of the each piece of paper 200 and output paper density signals. The paper quantity detecting unit 44 is electrically connected with the amplifying circuit unit 42 to receive the amplified paper signals for detecting a quantity of the amplified paper signals and output paper quantity signals. The analog-to-digital converter 45 is electrically connected with the paper density detecting unit 43 and the paper quantity detecting unit 44 for receiving and converting the paper density and quantity signals into digital signals. The processor 46 is electrically connected with the analog-to-digital converter 45. The digital signals are transmitted from the analog-to-digital converter 45 to the processor 46. The driving unit 47 is electrically connected with the processor 46. The driving unit 47 is electrically connected with the transmission mechanism 60.

Referring to FIG. 1, the feeding mechanism 50 is disposed behind the separation mechanism 30 for feeding the paper 200 transmitted by the separation mechanism 30 and passing through the ultrasonic circuit unit 40 backward to proceed a next step. The feeding mechanism 50 includes a feed driving pulley 51 and a feed following pulley 52. The feed driving pulley 51 and the feed following pulley 52 are mounted in the office equipment. The feed following pulley 52 is disposed above the feed driving pulley 51. The feeding mechanism 50 is disposed behind the ultrasonic circuit unit 40. The feed driving pulley 51 of the feeding mechanism 50 is driven by the transmission mechanism 60.

Referring to FIG. 1 to FIG. 2, when the paper feeding device 100 works, the transmission mechanism 60 drives the pickup mechanism 10 to pick up the paper 200 loaded in an input tray (not shown) of the office equipment, and the conveying mechanism 20 conveys the paper 200 to the separation mechanism 30. The separation mechanism 30 separates the paper 200 and transmits the separated paper 200 to the ultrasonic circuit unit 40 piece by piece. Then the ultrasonic detecting module 41 of the ultrasonic circuit unit 40 detects the paper signals, the amplifying circuit unit 42 amplifies the detected paper signals. In this preferred embodiment, the amplifying circuit unit 42 is a superposition of multiple amplifiers so as to amplify the paper signals into the amplified paper signals with needed magnifications.

The paper quantity detecting unit 44 detects the quantity of the paper from the amplified paper signals. When a detection result of the paper quantity detecting unit 44 is multiple pieces of paper 200, the output paper quantity signals are converted into first digital signals by the analog-to-digital converter 45, and then the first digital signals converted by the analog-to-digital converter 45 are transmitted to the processor 46. At the moment, the processor 46 controls the driving unit 47 to make the transmission mechanism 60 stop rotating. When the detection result of the paper quantity detecting unit 44 is a single piece of paper 200, the output paper quantity signals are converted into second digital signals by the analog-to-digital converter 45, and then the second digital signals converted by the analog-to-digital converter 45 are transmitted to the processor 46.

In the meanwhile, the paper density detecting unit 43 of the ultrasonic circuit unit 40 analyzes the density of the each piece of paper 200 to determine the thickness of the each piece of paper 200, and the output paper density signals are converted into third digital signals by the analog-to-digital converter 45, and then the third digital signals converted by the analog-to-digital converter 45 are transmitted to the processor 46. The digital signals include the first digital signals, the second digital signals and the third digital signals. The processor 46 controls the driving unit 47 to modulate rotation speeds of the transmission mechanism 60 for being appropriate to different thicknesses of the paper 200. Correspondingly, paper feeding speeds of the paper feeding device 100 are modulated by virtue of modulating the rotation speeds of the transmission mechanism 60 for being appropriate to the different thicknesses of the paper 200. The thinner the paper 200 is, the slower the rotation speed of the transmission mechanism 60 is. The thicker the paper 200 is, the faster the rotation speed of the transmission mechanism 60 is. After that, the paper 200 passing through the ultrasonic circuit unit 40 is transmitted to the feeding mechanism 50, and the transmission mechanism 60 drives the feeding mechanism 50 to transmit the paper 200 backwards to proceed with the next action.

As described above, the ultrasonic circuit unit 40 analyzes the density of the each piece of paper 200 to determine the thickness of the each piece of paper 200 to modulate the rotation speeds of the transmission mechanism 60 for being appropriate to the different thicknesses of the paper 200, even the paper 200 is thinner, the paper feeding device 100 is capable of effectively preventing the paper 200 being damaged. As a result, image quality of the office equipment applying the paper feeding device 100 is improved.

What is claimed is:

1. A paper feeding device, comprising:

a pickup mechanism for picking up paper and transmitting the paper backward;

a conveying mechanism disposed behind the pickup mechanism for conveying the paper transmitted by the pickup mechanism backward;

a separation mechanism disposed behind the conveying mechanism for separating the paper conveyed by the conveying mechanism and transmitting the separated paper backward;

a feeding mechanism disposed behind the separation mechanism for feeding the paper transmitted by the separation mechanism backward;

a transmission mechanism electrically connected with and rotatably driving the pickup mechanism, the conveying mechanism, the separation mechanism and the feeding mechanism; and an ultrasonic circuit unit disposed between the separation mechanism and the transmission mechanism, the ultrasonic circuit unit including:

an ultrasonic detecting module for detecting paper signals, an amplifying circuit unit electrically connected with the ultrasonic detecting module for receiving and amplifying the paper signals into amplified paper signals, a paper density detecting unit electrically connected with the amplifying circuit unit for receiving and analyzing the amplified paper signals to obtain a density of each piece of paper to determine a thickness of the each piece of paper and output paper density signals, an analog-to-digital converter electrically connected with the paper density detecting unit for converting the paper density signals into digital signals, a driving unit electrically connected with and driving the transmission mechanism to rotate, and a processor electrically connected with the analog-to-digital converter and the driving unit, the processor receiving the digital signals from the analog-to-digital converter and controlling the driving unit based on the digital signals;

wherein the processor controls the driving unit to modulate rotation speeds of the transmission mechanism based on the digital signals according to different thicknesses of the paper determined by the paper density detecting unit.

2. The paper feeding device as claimed in claim 1, wherein the amplifying circuit unit is a superposition of multiple amplifiers so as to amplify the paper signals into the amplified paper signals with multiple magnifications.

3. The paper feeding device as claimed in claim 1, wherein the separation mechanism includes a separation driving pulley and a separation following pulley, the separation following pulley is disposed above the separation driving pulley, and the separation driving pulley is driven by the transmission mechanism.

4. The paper feeding device as claimed in claim 1, wherein the feeding mechanism includes a feed driving pulley and a feed following pulley, the feed following pulley is disposed above the feed driving pulley, and the feed driving pulley is driven by the transmission mechanism.

5. The paper feeding device as claimed in claim 1, wherein the feeding mechanism is disposed behind the ultrasonic circuit unit, and paper feeding speeds of the paper feeding device are modulated by virtue of modulating the rotation speeds of the transmission mechanism for being appropriate to the different thicknesses of the paper.

6. The paper feeding device as claimed in claim 1, wherein the transmission mechanism is a motor.

7. A paper feeding device, comprising:

a pickup mechanism for picking up paper and transmitting the paper backward;

a conveying mechanism disposed behind the pickup mechanism for conveying the paper transmitted by the pickup mechanism backward;

a separation mechanism disposed behind the conveying mechanism for separating the paper conveyed by the conveying mechanism and transmitting the separated paper backward;

a feeding mechanism disposed behind the separation mechanism for feeding the paper transmitted by the separation mechanism backward;

a transmission mechanism electrically connected with and rotatably driving the pickup mechanism, the conveying mechanism, the separation mechanism and the feeding mechanism; and an ultrasonic circuit unit disposed between the separation mechanism and the transmission mechanism, the ultrasonic circuit unit including:

an ultrasonic detecting module for detecting paper signals, an amplifying circuit unit electrically connected with the ultrasonic detecting module for receiving and amplifying the paper signals into amplified paper signals, a paper density detecting unit electrically connected with the amplifying circuit unit for receiving and analyzing the amplified paper signals to obtain a density of each piece of paper to determine a thickness of the each piece of paper and output paper density signals, an analog-to-digital converter electrically connected with the paper density detecting unit for converting the paper density signals into digital signals, a driving unit electrically connected with and driving the transmission mechanism to rotate, and a processor electrically connected with the analog-to-digital converter and the driving unit, the processor receiving the digital signals from the analog-to-digital converter and controlling the driving unit based on the digital signals;

wherein the processor controls the driving unit to modulate rotation speeds of the transmission mechanism based on the digital signals according to different thickness of the paper determined by the paper density detecting unit, the ultrasonic circuit unit further includes a paper quantity detecting unit electrically connected with the amplifying circuit unit for detecting a quantity of the amplified paper signals, and the analog-to-digital converter is electrically connected with the paper quantity detecting unit.

8. A paper feeding device, comprising:

a pickup mechanism for picking up paper and transmitting the paper backward;

a conveying mechanism disposed behind the pickup mechanism for conveying the paper transmitted by the pickup mechanism backward;

a separation mechanism disposed behind the conveying mechanism for separating the paper conveyed by the conveying mechanism and transmitting the separated paper backward;

a feeding mechanism disposed behind the separation mechanism for feeding the paper transmitted by the separation mechanism backward;

a transmission mechanism electrically connected with and rotatably driving the pickup mechanism, the conveying mechanism, the separation mechanism and the feeding mechanism; and an ultrasonic circuit unit disposed between the separation mechanism and the transmission mechanism, the ultrasonic circuit unit including:

an ultrasonic detecting module for detecting paper signals, an amplifying circuit unit electrically connected with the ultrasonic detecting module for receiving and amplifying the paper signals into amplified paper signals, a paper density detecting unit electrically connected with the amplifying circuit unit for receiving and analyzing the amplified paper signals to obtain a density of each piece of paper to determine a thickness of the each piece of paper and output paper density signals, an analog-to-digital converter electrically connected with the paper density detecting unit for converting the paper density signals into digital signals, a driving unit electrically connected with and driving the transmission mechanism to rotate, and a processor electrically connected with the analog-to-digital converter and the driving unit, the processor receiving the digital signals from the analog-to-digital converter and controlling the driving unit based on the digital signals;

wherein the processor controls the driving unit to modulate rotation speeds of the transmission mechanism based on the digital signals according to different thickness of the paper determined by the paper density detecting unit, the pickup mechanism includes a pickup driving pulley and a pickup following pulley, the pickup following pulley is disposed above the pickup driving pulley, and the pickup driving pulley is driven by the transmission mechanism.

* * * * *